US007610853B2

(12) United States Patent
Luginbühl

(10) Patent No.: US 7,610,853 B2
(45) Date of Patent: Nov. 3, 2009

(54) INKING ROLLER COMPRISING A STRUCTURED SURFACE

(75) Inventor: Beat Luginbühl, Leissigen (CH)

(73) Assignee: Maschinenfabrik WIFAG, Bern (CH)

( * ) Notice: Subject to any disclaimer, the term of this patent is extended or adjusted under 35 U.S.C. 154(b) by 43 days.

(21) Appl. No.: 10/542,693

(22) PCT Filed: Oct. 21, 2004

(86) PCT No.: PCT/CH2004/000634

§ 371 (c)(1),
(2), (4) Date: Jul. 19, 2005

(87) PCT Pub. No.: WO2005/037555

PCT Pub. Date: Apr. 28, 2005

(65) Prior Publication Data

US 2006/0130685 A1 Jun. 22, 2006

(30) Foreign Application Priority Data

Oct. 21, 2003 (DE) ..... 203 16 112 U

(51) Int. Cl.
*B41F 31/00* (2006.01)

(52) U.S. Cl. ..... 101/352.13; 101/348; 101/349.1; 101/352.11

(58) Field of Classification Search ..... 101/352.11, 101/352.13
See application file for complete search history.

(56) References Cited

U.S. PATENT DOCUMENTS

| | | | | |
|---|---|---|---|---|
| 2,213,419 | A | 9/1940 | Taylor | |
| 2,338,635 | A * | 1/1944 | Galber | 492/33 |
| 2,369,814 | A | 2/1945 | Worthington | |
| 3,613,575 | A * | 10/1971 | Kantor | 101/148 |
| 3,690,254 | A * | 9/1972 | Krochert et. al. | 101/352.13 |
| 4,033,262 | A | 7/1977 | Johne et al. | |
| 4,287,827 | A * | 9/1981 | Warner | 101/141 |
| 4,537,127 | A * | 8/1985 | Fadner et al. | 101/141 |
| 4,567,827 | A * | 2/1986 | Fadner | 101/352.11 |
| 4,819,558 | A * | 4/1989 | Counard | 101/348 |
| 5,016,530 | A * | 5/1991 | Palmatier | 101/352.13 |
| 5,222,434 | A | 6/1993 | Smith et al. | |
| 6,701,839 | B1 * | 3/2004 | Levy | 101/352.13 |

FOREIGN PATENT DOCUMENTS

| | | |
|---|---|---|
| DE | 39 32 694 A1 | 7/1990 |
| DE | 40 28 417 A1 | 5/1991 |
| EP | 0 425 829 A2 | 5/1991 |
| GB | 731 530 | 6/1955 |

* cited by examiner

*Primary Examiner*—Jill E. Culler
(74) *Attorney, Agent, or Firm*—McGlew & Tuttle, P.C.

(57) ABSTRACT

An inking roller for an inking system has, distributed over the surface on a ink-transferring surface (S), circumferential flutes (3). The longitudinal flutes (4) intersect the circumferential flutes (3) and elevated surface areas as said webs (5) and between the circumferential and longitudinal flutes (3, 4).

20 Claims, 3 Drawing Sheets

INKING ROLLER COMPRISING A STRUCTURED SURFACE

CROSS REFERENCE TO RELATED APPLICATIONS

This application is a United States National Phase application of International Application PCT/CH2004/000634 and claims the benefit of priority under 35 U.S.C. §119 of German Application DE 203 16 112.2 filed Oct. 21, 2004, the entire contents of which are incorporated herein by reference.

FIELD OF THE INVENTION

The present invention pertains to an inking roller, whose ink-transferring surface is structured, to an inking system, especially a film-type inking system, with a duct roller and with an inking roller according to the present invention, which takes up the ink from the ductor, and to a rotary offset printing couple with the inking roller and all components for transferring a printed image. The present invention pertains, in particular, to web printing.

BACKGROUND OF THE INVENTION

It is known that a water-ink emulsion with high water content may be formed in the pinking system during offset printing on areas of the plate that are free from image or carry little ink, and this emulsion causes streaky differences in ink management in these areas. Since the emulsion with high water content cannot be distributed any longer by the changing distributor roller because the distributor roller slips away over it, streaky fields with too much emulsified ink will form in the inking system during the operation of the press. This happens especially in film-type inking systems in which the ink splitting process of the ink is less intense because of the small gap that is always present between the duct roller and the film roller and therefore leads to toning of the printing plate and to undesired spraying of the ink.

Furthermore, it is known that especially in high-speed rotary offset presses, moistening agents split back into the inking system from the printing plate via the transfer rollers. The film roller as the last roller in the roller train, located at a short distance from the duct roller, cannot further split any moistening agent.

Circumferential water rings are formed on the hydrophilic film roller surface with flute-shaped recesses provided in the circumferential direction. The water rings building up compensate the distance from the adjacent duct roller, so that moistening agent reaches the ink duct via the duct roller. The homogeneous ink film on the duct roller is disturbed and the ink transfer up to the plate cylinder is adversely affected.

The moistening agent evaporation time, which becomes shorter in high-speed offset printing presses, has another adverse effect on the quantity of moistening agent in the ink duct.

SUMMARY OF THE INVENTION

One object of the present invention is to avoid the presence of moistening agent on the ink-carrying rollers more extensively than before.

This is achieved according to the present invention in that at least one film or fluted roller of the inking system, which said roller adjoins the duct roller, which will hereinafter also be called simply inking roller, is provided in the ink delivery direction with a profiled jacket surface that brings about the ink film in the circumferential and axial directions. The continuous lateral distribution of the printing ink and the water rings forming in the circumferential direction on the ink film are prevented by this measure from occurring nearly completely without an additional effort.

Even though it is known that the surface of ink film rollers can be designed as a sinusoidal fluted roller, these flutes, which are closed in themselves in the circumferential direction, do permit circumferential water rings to be formed.

Furthermore, it is known that film rollers can be provided with a diagonally knurled roller profile. The fine, sharp-edged grids on the jacket surface may cause ink splashes on the adjacent parts of the press in high-speed printing presses. The cleaning of the fine depressions of the grids to remove printing ink is also complicated.

Furthermore, the longitudinal profiling of the jacket surface of ink film rollers in the axial direction with a slope angle in relation to the axis of rotation has been known in this area of the printing industry. These rollers tend to be characterized by a continuous lateral ink shift on the jacket surface (e.g., DE 39 32 694, EP 425 829, DE 40 28 417, U.S. Pat. No. 2,369, 814).

For improvement, the jacket surface of at least one of the inking rollers is provided with a profile according to the present invention in the inking system of an offset printing press, which profile may have especially sinusoidal flutes in the circumferential direction and especially straight flutes in the axial direction, with a slope angle in relation to the axis of rotation.

The roller profile according to the present invention is preferably prepared by grinding or milling.

The advantages provided in case of:

preferably at least 18 longitudinal flutes with a slope angle greater than 0° to 30° and preferably 10° in relation to the axis of rotation and a plurality of longitudinal flutes, preferably sinusoidal flutes with an amplitude of about 4.75 mm and a degree of overlap of about 1.9 (9.5/4.75) are:

- No splitting of moistening water from the ink film roller to the ink ductor or into the ink duct, and consequently homogeneous ink film formation on the ductor, especially at high press speeds (>10 m/sec);
- the interrupted flute structure prevents circumferential moistening water rings or surface water from forming;
- pre-moistening or after-moistening is possible;
- continuous, "beat-free milling off of ink" from the ductor;
- no lateral ink transport on one side in the axial direction of the inking roller;
- no regrinding of the inking roller diameter;
- inking rollers with existing sinus profile can be retrofitted;
- no complicated cleaning.

The circumferential and longitudinal flutes should be arranged in a uniform distribution over the circumference of the ink-transferring surface and form a regular surface structure.

The film roller is used for continuous ink feed into the inking system. It is a steel or plastic-coated roller with surface structure. The profiling is necessary to enable this roller to "mill off" an ink film from the ductor. The film roller is contactless in relation to the ductor.

It has a circumferential velocity corresponding to the velocity of the web. The velocity of the ductor is several times lower.

The advantages of a film roller over a vibrating roller are that the ink transfer takes place continuously rather than intermittently.

Inking systems can thus be made shorter because the ink transfer, which is intermittent in case of vibrating roller type inking systems, does not need to be compensated by a long inking system.

A great variety of profiled rollers are known:

fluted rollers, corrugated or diagonally knurled rollers, longitudinally corrugated rollers, etc.

Longitudinally corrugated surfaces lead to intermittent ink transfer. Surfaces structured too fine are difficult to clean and tend to increased spraying.

The film roller profile of the invention presents novel features including:

continuous surface structure, minimum roller surface, no closed surfaces extending circumferentially in one plane, possibility of good cleaning, manufacture at low cost.

The homogeneously structured roller surface consisting of a combination of a circumferential profiling and a longitudinal profiling.

The lamellar structure thus left guarantees continuous, clean and reproducible ink transfer and extensively prevents the splitting of moistening agent into the ink ductor/ink film roller ink transfer zone.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
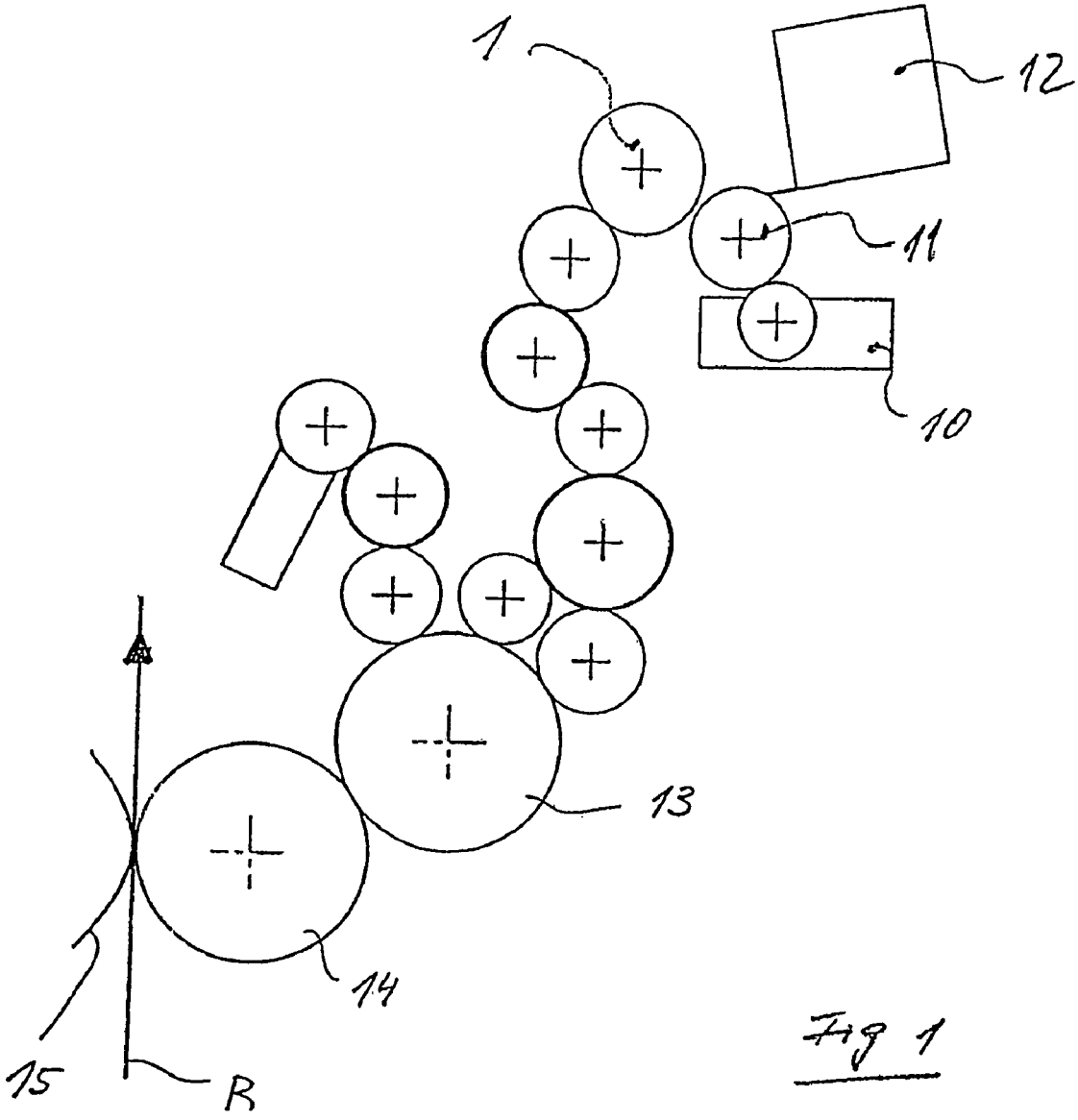
FIG. 1 is a schematic view showing an offset printing couple of a rotary printing press according to the invention.

Referring to the drawings in particular, FIG. 1 shows an offset printing couple of a rotary printing press. The printing couple comprises a printing form cylinder or plate cylinder 13, a rubber blanket cylinder 14 and an inking and dampening system. The inking system of the printing couple comprises an ink duct 10, a ductor roller 11, a doctor blade bar 12 engaged with the ductor roller 11, a film or fluted roller 1 and other ink transfer rollers between the film or fluted roller 1 and the printing form cylinder 13. With a mating cylinder 15, the rubber blanket cylinder 14 forms a printing gap, in which a web B passing through is printed on, on one side or on both sides.

Figure 2:
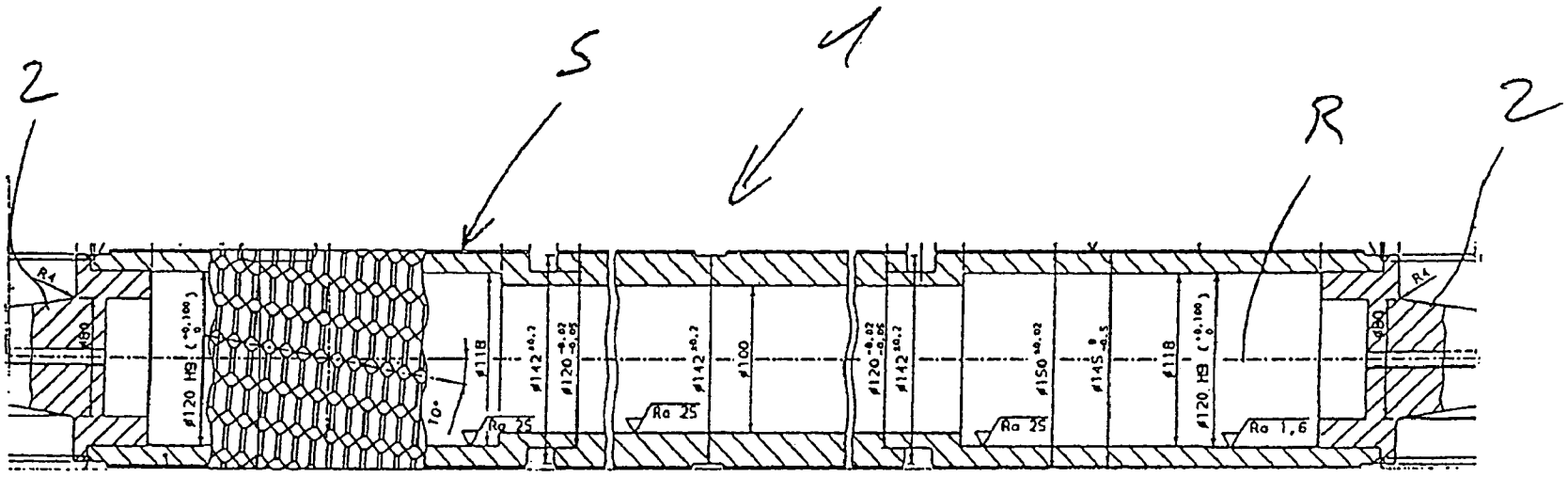
FIG. 2 is a schematic partially sectional view showing an individual film or fluted roller.

The film or fluted roller 1 is shown individually in FIG. 2. It comprises a roller body with an ink-transferring roller surface S and a roller pin 2 each at its two axial ends for the rotary mounting of the roller 1 about its axis of rotation R. The ink-transferring surface S is structured according to the present invention, as it is indicated for the left-hand axial end of roller 1 in FIG. 2.

Figure 3:
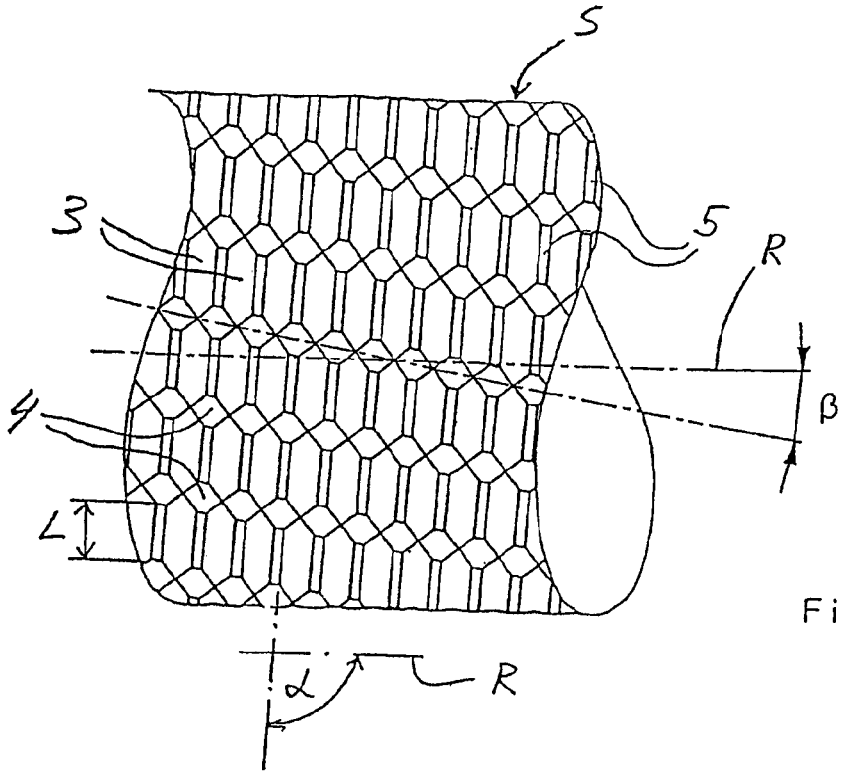
FIG. 3 is an axial sectional view of the surface S.

FIG. 3 shows the surface S of an axial section of the roller. The surface S is structured by circumferential flutes 3 located in parallel to and at spaced locations from one another along the axis of rotation R and essentially axially extending longitudinal flutes 4, which are likewise parallel to one another. The elevated surface areas or webs 5 left between the circumferential flutes 3 and longitudinal flutes 4 have a length of about 9 mm each, measured in the circumferential direction, i.e., in the layout at right angles to the axis of rotation R. The circumferential flutes 3 extend in a wave-shaped pattern over the circumference, as a sine wave with a valley and a peak in the exemplary embodiment, The amplitude measured in parallel to the axis of rotation R is about 5 mm, i.e., the distance between the peak and valley is approx. 10 mm. The pitch, changing because of the sinusoidal course over the circumference and expressed by the slope angle $\alpha$ measured in relation to the axis of rotation R, varies over the circumference between 90° and about 87°. The slope angle $\beta$, at which the longitudinal flutes 4 are sloped in relation to the axis of rotation R, is approx. 10°.

Figure 4:
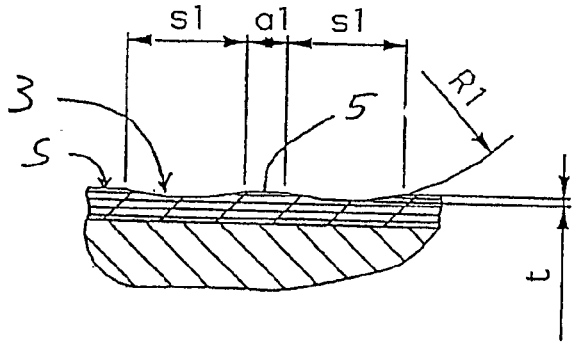
FIG. 4 is a broken away sectional view showing the profile of two adjacent circumferential flutes.

FIG. 4 shows the profile of two adjacent circumferential flutes 3 of the surface S of the roller. The web 5 is shown having a contact surface of a width a1. The flutes 3 at each side have a groove width s1.

Figure 5:
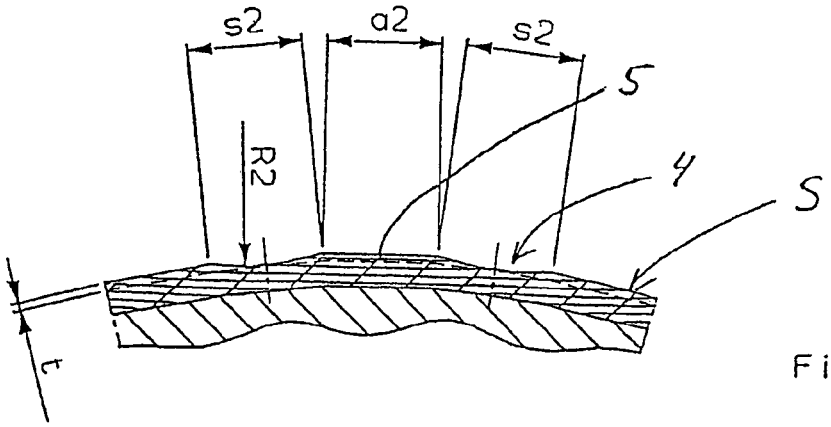
FIG. 5 is a broken away sectional view showing the profile of two adjacent longitudinal flutes.

FIG. 5 shows the profile of two adjacent longitudinal flutes 4. The web 5 is shown having a contact surface of a length a2. The longitudinal flutes 4 at each side have a groove width s2.

The webs 5 are sharp-edged. The preferred parameters of the surface structure are advantageously with a circumferential profile that has a closed circumferential flute profile with the groove width s1, a flute shape R1 and a groove depth t. The circumferential flute describes a sine curve with an amplitude of 0 mm to 50 mm and preferably 4.75 mm. The degree of overlap is the ratio of the flute width to the amplitude and is between 1.6 and 2.4. Preferably the ratio of the flute width to the amplitude is about 2.0. The groove depth is between 0.5 mm and 1 mm. Preferably the groove depth is about 0.6 mm. The distances a1 between the flutes are between 1 mm and 5 mm. Preferably distances a1 between the flutes is <3 mm.

The longitudinal Profile is advantageously provided having a groove width s2, a flute shape R2 and a groove depth t that is similar to the profile of the circumferential flute. The angle of slope $\beta$ in relation to the axis of rotation is between 0° and 30°. Preferably the angle of slope $\beta$ in relation to the axis of rotation is <10°.

The surface structure is provided with the combination of the number of circumferential and longitudinal flutes is selected to be such that the remaining jacket surface $\Sigma A$ is between 10% and 20% of the total roller surface.

The roller material is advantageously a steel body with plastic-coated roller jacket, e.g., hard rubber, polyamide, polyurethane, etc.

While specific embodiments of the invention have been shown and described in detail to illustrate the application of the principles of the invention, it will be understood that the invention may be embodied otherwise without departing from such principles.

The invention claimed is:

1. An inking roller for an inking system, the inking roller comprising:

an ink-transferring surface;

a plurality of circumferential flutes distributed over said ink-transferring surface;

a plurality of longitudinal flutes distributed over said ink-transferring surface, said plurality of longitudinal flutes intersecting said plurality of circumferential flutes;

elevated surface areas as webs between said plurality of circumferential and said plurality of longitudinal flutes, said elevated surface areas constituting less than 15% of said ink-transferring surface;

said flutes and said elevated surface areas being arranged to create a wave-shaped pattern on said ink-transferring surface in a longitudinal and a circumferential direction, a crest of said wave-shaped pattern as viewed in said circumferential direction being longer than a crest of said wave-shaped pattern as viewed in said longitudinal direction, a trough of said wave-shaped pattern as viewed in said circumferential direction being smaller than a trough of said wave-shaped pattern as viewed in said longitudinal direction.

2. An inking roller in accordance with claim 1, wherein the webs have a length of at least 5 mm each, measured in the circumferential direction of the inking roller.

3. An inking roller in accordance with claim 1, wherein the webs have a length of at most 30 mm each, measured in the circumferential direction of the inking roller.

4. An inking roller in accordance with claim 1, wherein the circumferential flutes extend with a slope in relation to the axis of rotation (R) of the inking roller in a layout of the surface and a slope angle along the circumferential flutes is always greater than 70°.

5. An inking roller in accordance with claim 1, wherein each of the circumferential flutes runs back into itself.

6. An inking roller in accordance with claim 1, wherein the circumferential flutes have a continuously curved course.

7. An inking roller in accordance with claim 1, wherein the circumferential flutes extend in a wave-shaped pattern with an amplitude of preferably between 3 mm and 50 mm.

8. An inking system, comprising:

a printing form cylinder or plate cylinder;

a rubber blanket cylinder;

an inking and dampening system with an ink duct, a ductor roller, a doctor blade bar engaged with the ductor roller and a film or fluted roller;

other ink transfer rollers between the film or fluted roller;

a mating cylinder, the rubber blanket cylinder forming a printing gap, in which a web passing through is printed on, on one side or on both sides, the film or fluted roller comprising a ink-transferring surface with predominately circumferential flutes distributed over the ink-transfer surface and, predominately longitudinal flutes intersecting the circumferential flutes and elevated surface areas as disposed between the circumferential and longitudinal flutes.

9. An inking system in accordance with claim 8, wherein the elevated surface areas have a length of at least 5 mm each, measured in the circumferential direction of the inking roller.

10. An inking system in accordance with claim 9, wherein the elevated surface areas have a length of at most 30 mm each, measured in the circumferential direction of the inking roller.

11. An inking system in accordance with claim 8, wherein the circumferential flutes extend with a slope in relation to the axis of rotation of the inking roller in a layout of the surface and a slope angle along the circumferential flutes is always greater than 70°.

12. An inking system in accordance with claim 11, wherein each of the circumferential flutes run back into itself.

13. An inking system in accordance with claim 11, wherein the circumferential flutes have a continuously curved course; and the elevated surface areas form between 10% and 20% of a total roller surface.

14. An inking system in accordance with claim 11, wherein the circumferential flutes extend in a wave-shaped pattern with an amplitude of preferably between 3 mm and 50 mm.

15. An inking system comprising:

an inking roller including a ink-transferring surface, said surface defining a plurality of circumferential flutes extending predominantly in a circumferential direction of said inking roller, said surface defining a plurality of longitudinal flutes extending predominantly in a longitudinal direction of said inking roller.

16. A system in accordance with claim 15, wherein:

said inking roller has a rotational axis;

said circumferential flutes extend in a direction greater than 70° from said rotational axis.

17. A system in accordance with claim 16, wherein:

said direction of said circumferential flutes continuously curves between 70° and 90° with respect to said rotational axis, as said circumferential flutes extend around said surface of said inking roller.

18. A system in accordance with claim 17, wherein:

said continuously curving direction of said circumferential flutes forms a wave shaped pattern with an amplitude of approximately 3 mm to 50 mm.

19. A system in accordance with claim 15, wherein:

each of said circumferential flutes forms a closed loop around said surface of said inking roller.

20. A system in accordance with claim 15, wherein:

elevated surface areas are disposed between the circumferential and longitudinal flutes; and the elevated surface areas form between 10% and 20% of a total roller surface.

* * * * *